US005178473A

United States Patent [19]

Oexler et al.

[11] Patent Number: 5,178,473

[45] Date of Patent: Jan. 12, 1993

[54] SUPPORTING-DISK BEARING

[75] Inventors: Rudolf Oexler, Ingolstadt; Hans Landwehrkamp, Lenting; Kurt Beitzinger, Ingolstadt, all of Fed. Rep. of Germany

[73] Assignee: Schubert & Salzer Maschinenfabrik Aktiengesellschaft, Ingolstadt, Fed. Rep. of Germany

[21] Appl. No.: 465,943

[22] Filed: Jan. 16, 1990

Related U.S. Application Data

[63] Continuation of Ser. No. 93,125, Sep. 1, 1987, which is a continuation of Ser. No. 674,597, Nov. 26, 1984, abandoned.

[30] Foreign Application Priority Data

Nov. 25, 1983 [DE] Fed. Rep. of Germany ..... 3342768
Nov. 30, 1983 [DE] Fed. Rep. of Germany ..... 84113341

[51] Int. Cl.[5] ..... F16C 13/00; D01H 1/24

[52] U.S. Cl. ..... 384/549; 57/103; 57/406

[58] Field of Search ..... 384/549; 57/103, 406; 474/188, 189

[56] References Cited

U.S. PATENT DOCUMENTS

| | | | |
|---|---|---|---|
| 306,538 | 10/1884 | Shepherd | 474/189 |
| 593,366 | 11/1897 | Tillison | 474/189 |
| 2,639,560 | 5/1953 | Cosmos | 474/188 |
| 3,295,801 | 1/1967 | McDowall et al. | 384/549 X |
| 3,313,096 | 4/1967 | Marciniak | 57/103 X |
| 3,578,751 | 5/1971 | Kodaira | 57/103 |
| 3,635,009 | 1/1972 | Mattingly | 57/77.45 |
| 3,747,315 | 7/1973 | Paget | 57/77.45 |
| 3,793,820 | 2/1974 | Rajnoha | 57/58.89 |
| 3,877,212 | 4/1975 | Carzler | 57/100 |
| 3,901,011 | 8/1975 | Schuster | 57/77.4 |
| 4,041,688 | 8/1977 | Stahlecker | 57/104 |
| 4,070,814 | 1/1978 | Goldhammer et al. | 57/89 |
| 4,077,197 | 3/1978 | Bowden et al. | 57/156 |
| 4,098,065 | 7/1978 | Stahlecker et al. | 57/58.95 |
| 4,149,365 | 4/1979 | Kobayashi et al. | 57/104 |
| 4,183,199 | 1/1980 | Schumann | 57/89 |
| 4,509,933 | 4/1985 | Miranti, Jr. et al. | 474/93 |
| 4,667,464 | 5/1987 | Stahlecker et al. | 57/406 |
| 4,676,673 | 6/1987 | Stahlecker et al. | 384/549 |

FOREIGN PATENT DOCUMENTS

| | | |
|---|---|---|
| 2112913 | 10/1972 | Fed. Rep. of Germany . |
| 2206237 | 8/1973 | Fed. Rep. of Germany . |
| 2206264 | 8/1973 | Fed. Rep. of Germany . |

*Primary Examiner*—Thomas R. Hannon
*Attorney, Agent, or Firm*—Dority & Manning

[57] ABSTRACT

A supporting-disk bearing, particularly for the shaft of an open-end spinning rotor, the shaft (1) being mounted in a wedge-shaped gap formed by supporting disks (4, 5), and the supporting disks (4, 5) having a running surface (40,50) consisting of an elastic covering against which the shaft (1) is pressed. The running surface (40,50) has at least one interruption formed by a recess and bridged by the line of contact of the shaft (1). The recess can be designed in various ways, but it is preferably groove-shaped. The wear of the running surface is reduced as a result of this design.

3 Claims, 1 Drawing Sheet

SUPPORTING-DISK BEARING

This is a continuation of application Ser. No. 07/093,125 filed Sep. 1, 1987, which is a continuation of U.S. Ser. No. 06/674,597 filed on Nov. 26, 1984, now abandoned.

FIELD OF THE INVENTION

The invention relates to a supporting-disk bearing, especially for the shaft of an open-end spinning rotor, the shaft being mounted in a wedge-shaped gap formed by the supporting disks, and the supporting disks having a running surface consisting of an elastic covering against which the shaft is pressed.

BACKGROUND OF THE INVENTION

It is known to mount the shaft of an open-end spinning rotor radially in the wedge-shaped gap formed by supporting disks and at the same time, to press it against the supporting disks by means of a tangential belt or a pressure roller (German Offenlegungsschrift 1,901,453). The supporting disks are provided with coverings consisting of damping material, for example, plastic, in order to guarantee quiet running of the spinning rotor rotating at high speeds and reduce the noise. During operation, the running surface is exposed, due to the shaft rotating at high speed and pressed against the running surface with the pressure required for the drive, to a considerable stress which is further intensified as a result of a prevailing balance and an axial thrust (German Offenlegungsschrift 2,112,913) generated via the supporting disks and exerted on the shaft. This stress results in relatively rapid wear and in the destruction of the running surface and consequently the rotor mounting. It is necessary to exchange the supporting disks, which, because of the plurality of spinning stations, each time entails considerable costs in terms of material, assembly and lost production time of the machine.

SUMMARY OF THE INVENTION

The object of the present invention is to improve a supporting-disk bearing in such a way that the useful life of the running surfaces and consequently of the rotor mounting as a whole is lengthened.

The object is achieved, according to the invention, because the running surface has at least one interruption formed by a recess which is bridged by the line of contact of the rotor shaft.

It has been shown, surprisingly, that a considerably longer useful life is achieved by means of the design according to the invention of the running surfaces of the supporting disks.

Advantageous developments of the invention are described in the sub-claims.

DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
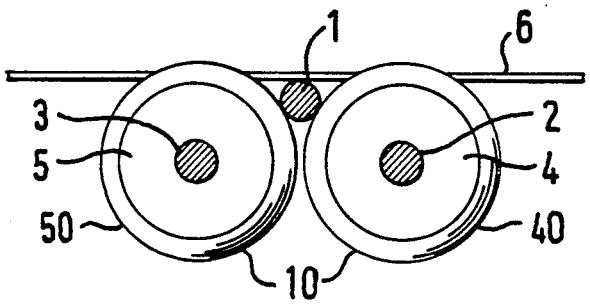
FIG. 1 shows a supporting-disk bearing for a rotor shaft driven by a tangential belt, as seen from the front.

According to FIG. 1, a shaft 1 of an open-end spinning rotor, for which the supporting-disk bearing is particularly intended, is mounted on the wedge-shaped gap between freely rotatably supporting disks 4 and 5 mounted in pairs on axles 2 and 3. The supporting disks 4 and 5 are provided on their periphery with an elastic covering which consists of plastic, for example, polyurethane, or of another suitable material and which forms a running surface 40, 50 for the shaft 1. A tangential belt 6 presses the shaft 1 against the running surface 40 and 50 with a predetermined pressure and drives it. Such a mounting is generally known and, therefore, does not need to be explained in any more detail, nor, in particular with regard to the axial thrust exerted on the shaft 1 via the supporting disks, during running, in order to press the latter against an axial bearing.

As already described in the introduction, in this mounting the plastic covering is exposed to a high stress which stems from the shaft 1 and which results in wear and destruction of the running surface 40 and 50. To counteract this and to lengthen the useful life of the running surface 40 and 50, the running surface is interrupted by recesses. These recesses can be designed and arranged in a variety of ways.

Figure 2:
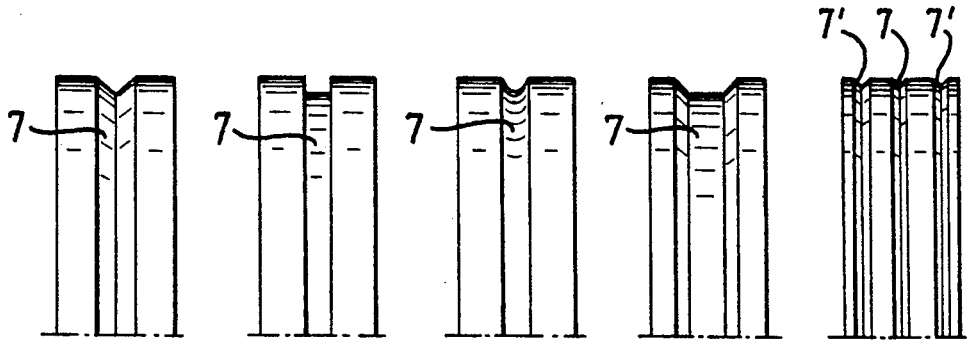
FIG. 2 shows, in a plan view, supporting disks with groove-shaped recesses in the running surface.

However, it is preferable to have a groove-shaped recess which extends in the direction of rotation of the supporting disk 4 and 5 and which is arranged in the center of the running surface 40 and 50 (FIG. 2). The form of such an endless groove 7 can vary. As the designs "a" to "d" in FIG. 2 show, the groove 7 can have, for example, a wedge-shaped, rectangular, semicircular or trapezoidal form. In the design "e" in FIG. 2, there are next to the central groove 7 two further grooves 7' extending parallel to the central groove, so that the running surface 40 or 50 is interrupted on its periphery by three recesses in all.

During operation, the shaft 1 rests on the running surfaces 40 and 50 on both sides of the groove 7 or 7', and the line of contact of the shaft, which can also become a surface of contact in the event of a higher pressing force of the shaft 1 on the elastic covering, bridges the groove freely. The fact that the shaft 1 rests on both sides of the recess guarantees that the shaft 1 rolls smoothly.

Figure 3:
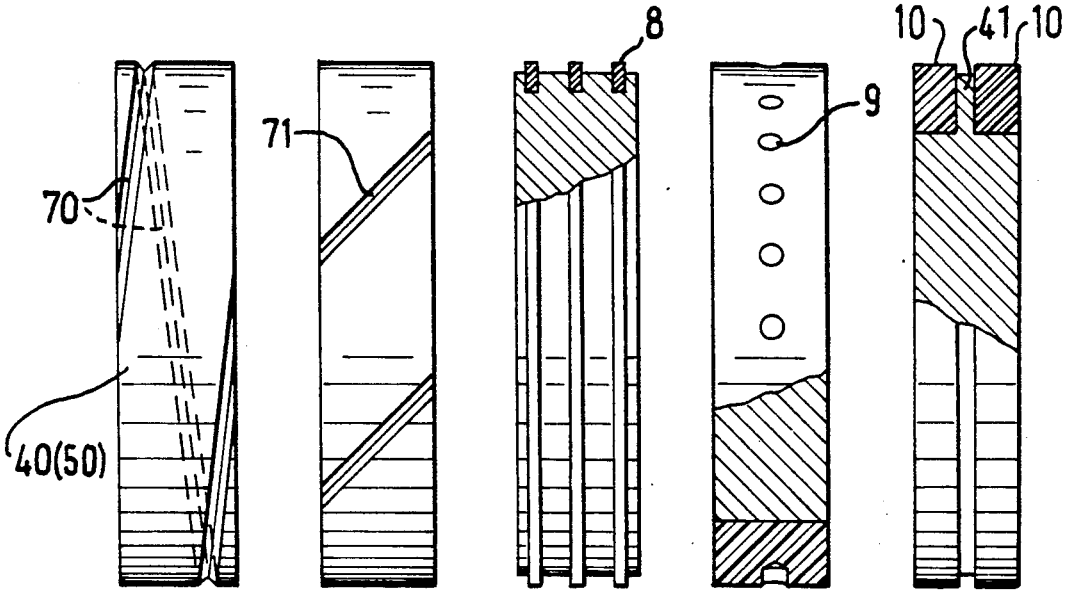
FIG. 3 shows, in a plan view and partially in section, further possibilities of interrupting the running surface by means of recesses.

FIG. 3 illustrates further possibilities for forming recesses to interrupt the running surface. In the design "a", a groove 70 extends spirally over the periphery of the running surface. The design "b" shows a running surface which is interrupted by several grooves 71 arranged at an angle to the direction of rotation of the supporting disk and at a distance from one another. The angle and width of the grooves 71 are selected so that the shaft 1 cannot fall into the grooves, but bridges them. From previous experience, the smooth running of the spinning rotor is not impaired because the grooves 71, and also the groove 70 in the design "a" in FIG. 3, extend up to the edge of the running surface, since in the region in which the groove terminates at the edge, the running surface is sufficiently large for the shaft. However, if appropriate, the groove 71 or 70 can also end before the edge of the running surface, should this prove necessary.

Furthermore, it is also possible to embed plastic ribs 8 at a distance from one another in the basic body of the supporting disk, thus again resulting in a running surface interrupted by recesses. In the design "d" in FIG. 3, the recesses are formed by bores 9 which are arranged in a row behind one another in the center of the running surface. In the design "e", the basic body of the supporting disk is provided with a web 41 which extends into the vicinity of the running surface and which, together with the elastic covering, forms a recess.

The effect of the invention seems to be based on the fact that an airstream is generated in the recesses as a result of the rotation of the supporting disks, and this airstream brings about cooling of the elastic covering and thereby reduces wear caused by overheating. To achieve better deat dissipation and consequently prevent an accumulation of heat resulting in the destruction of the covering, the recess must have appropriate dimensions. In tests with a covering 6 mm thick, the result has been, for example, that a recess with a depth of approximately up to one third of the thickness of the covering is especially effective. It is likewise necessary to ensure, as regards the width of the recess, that effective ventilation and consequently heat dissipation are guaranteed.

It will be understood, of course, that while the form of the invention herein shown and described constitutes a preferred embodiment of the invention, it is not intended to illustrate all possible forms of the invention. It will also be understood that the words used are words of description rather than of limitation and that various changes may be made without departing from the spirit and scope of the invention herein disclosed.

What I claim is:

1. A supporting-disk bearing for use in an open-end spinning machine having a spinning rotor provided in said spinning machine, an elongated drive shaft extending outwardly from said spinning rotor, a pair of supporting disks disposed in said spinning machine to receive said drive shaft in rotational engagement therewith, said supporting disks arranged to form a wedge shape gap, said elongated drive shaft mounted in said wedge shaped gap with said shaft being pressed against a running surface on each of said disks, the improvement comprising:

said running surface on said support disks including an elastic covering of predetermined thickness, said running surface is formed by covering ribs arranged at a distance from one another, and said ribs being bridged by the line of contact with said elongated drive shaft so as to enhance heat dissipation and consequently minimize heat build-up within each said elastic covering during high speed rotation of the rotor.

2. A supporting-disk bearing for use in an open-end spinning machine having a spinning rotor provided in said spinning machine, an elongated drive shaft extending outwardly from said spinning rotor, a pair of supporting disks disposed in said spinning machine to receive said drive shaft in rotational engagement therewith, said supporting disks arranged to form a wedge shape gap, said elongated drive shaft mounted in said wedge shaped gap with said shaft being pressed against a running surface on each of said disks, the improvement comprising:

said running surface on said support disks including an elastic covering of predetermined thickness, said running surface is interrupted by bores arranged in a row behind one another, and said bores enhancing heat dissipation and consequently minimize heat build-up within each said elastic covering during high speed rotation of the rotor.

3. A supporting-disk bearing for use in an open-end spinning machine having a spinning rotor provided in said spinning machine, an elongated drive shaft extending outwardly from said spinning rotor, a pair of supporting disks disposed in said spinning machine to receive said drive shaft in rotational engagement therewith, said supporting disks arranged to form a wedge shape gap, said elongated drive shaft mounted in said wedge shaped gap with said shaft being pressed against a running surface on each of said disks, the improvement comprising:

said running surface on said support disks including an elastic covering of predetermined thickness, a basic body of said supporting disk is provided with a web which extends into the vicinity of the running surface and which, together with the covering, forms a recess, and said recess being bridged by the line of contact with said elongated drive shaft so as to enhance heat dissipation and consequently minimize heat build-up within each said elastic covering during high speed rotation of the rotor.

* * * * *